United States Patent [19]

Dusko

[11] 4,175,809

[45] Nov. 27, 1979

[54] ROTATABLE ELECTRICAL CONNECTOR UNITS AND LIGHTING DEVICES INCORPORATING SAME

[76] Inventor: Joseph R. Dusko, 3436 Cascade Dr., Youngstown, Ohio 44511

[21] Appl. No.: 894,394

[22] Filed: Apr. 7, 1978

[51] Int. Cl.[2] ..... H01R 39/00

[52] U.S. Cl. ..... 339/1 L; 339/8 R; 362/413

[58] Field of Search ..... 339/1, 2, 5, 6, 8; 362/395, 413

[56] References Cited

U.S. PATENT DOCUMENTS

| | | | |
|---|---|---|---|
| 490,903 | 1/1893 | Gartland | 339/2 A |
| 958,448 | 5/1910 | Vossberg | 339/2 A |
| 2,833,996 | 5/1958 | Whicker et al. | 339/2 L |

FOREIGN PATENT DOCUMENTS

| | | | |
|---|---|---|---|
| 880905 | 5/1953 | Fed. Rep. of Germany | 339/5 P |
| 1055042 | 10/1953 | France | 362/413 |
| 22138 | of 1912 | United Kingdom | 339/8 R |
| 566985 | 1/1945 | United Kingdom | 339/5 M |

*Primary Examiner*—Joseph H. McGlynn
*Attorney, Agent, or Firm*—Watson, Cole, Grindle & Watson

[57] ABSTRACT

Disclosed are rotatable electrical connector units and adjustable lighting devices incorporating these units. The rotatable electrical connector unit in accordance with the invention comprises a shaft which is at least partially hollow and at least three electrically insulating discs mounted transversely on the shaft, each of the discs carrying at least one electrical contact ring. The electrical contact rings are arranged on the discs such that there are two pairs of electrical contact rings, each pair separated from each other, and such that the contact rings of each pair are in slidable electrical contact with each other. The unit further includes a housing about the shaft and the discs, a portion of the housing engaging at least one of the discs such that when the housing portion is rotated relative to the shaft, the engaged disc is caused to rotate about the shaft. At least four electrical conductors extend from the unit, each electrical conductor attached to a different contact ring.

16 Claims, 9 Drawing Figures

ROTATABLE ELECTRICAL CONNECTOR UNITS AND LIGHTING DEVICES INCORPORATING SAME

BACKGROUND OF THE INVENTION

The present invention is generally directed to electrical lighting devices and, more particularly, to an adjustable type lighting device where the illuminating portion is adapted to be manually repositioned to direct light to a variety of different positions and rotatable electrical connector units to be used in such an adjustable lighting device.

A variety of adjustable electrical lighting devices are known in the art. These devices are generally attached to and supported by a stationary surface and are adapted to allow the light emanating from the device to be directed to a variety of different positions and thereby regulate the light intensity on an object to be viewed by positioning the illuminating portion either closer or further away from the object. Commercially available electrical devices of this type generally include a plurality of arm members successively connected by swivel type joints, one end of the arm arrangement attached to a support surface and the other end to the illuminating or lamp portion of the device. Electric current is provided to the illuminating portion of the device by a pair of continuous electrical wires which pass through the arm arrangement or are closely associated therewith.

A significant problem in a device of this type is that after the device has been used for a period of time, the movement of the arms relative to each other during repositioning of the illuminating portion causes the continuous electrical wires to be repeatedly twisted and/or bent at the points where the arms are connected by the swivel joints. Such twisting and bending causes fatigue in the metal conducting portion of the electrical wires and may ultimately cause complete failure of the wires due to breakage of the metal conducting portion. Consequently, the lighting device is rendered inoperative and must be either repaired at considerable expense or discarded.

Examples of such lighting devices are shown in U.S. Pat. Nos. 2,389,340 to Bateman, 2,395,178 to Fiori, 2,820,885 to Neugass, 3,160,349 to Kent, 3,188,460 to Thorsen, et al, 3,213,273 to Zagel, 3,239,184 to Kirkeby and 3,970,835 to Crete. A characteristic of the devices disclosed in these patents is that the electrical wires connected to the illuminating portion of the devices are continuous and extend through the mechanical joints of the arms supporting the illuminating portion.

Also known in the art are axially rotatable or universal electrical connector units which do not have wires extending through the joint portion. These units may be used to conduct electrical current through a mechanical type joint without the possibility of electrical wire fatigue and consequent breakage of the wires. Examples of such units are illustrated in U.S. Pat. Nos. 913,831 to Low, et al, 958,448 to Vossberg, 2,259,999 to Bryant, et al, 2,652,546 to Christner, 2,519,933 to Rouault, 3,581,267 to Schreffler, 3,601,598 to Horn, 3,957,331 to Tantillo, et al and 3,963,291 to Maloof. These disclosed units are, however, generally cumbersome and would be difficult to manufacture on a large scale. In addition, these units are incapable of being held in a fixed position so as to be able to adequately support the weight of a lighting device in an extended position.

SUMMARY OF THE INVENTION

Accordingly, it is an object of the present invention to provide rotatable electrical connector units adapted for use in an adjustable lighting device, the units being freely movable, safe, non-arcing, capable of carrying relatively heavy currents, ruggedly constructed and relatively inexpensive to manufacture.

Another object of the present invention is to provide a rotatable electrical connector unit having electrical wires which permits continuous rotation of a portion of the unit with respect to the remainder of the unit without the possibility of wire fatigue and subsequent breakage while still maintaining good electrical contact.

A further object of the present invention is to provide rotatable electrical connector units adapted for use in an electrical lighting device which provide flexibility and adjustability of the device while completely eliminating the necessity for electrical wires passing through the complete unit and the lack of flexibility associated therewith.

Yet another object of the present invention is to provide an adjustable lighting device incorporating one or more rotatable electrical conductor units, the device capable of being detachably mounted on or fixedly secured to any supporting surface or supporting fixture and capable of being universally adjusted, extended or retracted to place the illuminating portion of the device in any desired position relative to a work area or surface.

Briefly, the present invention in its broader aspects is directed to a rotatable connector unit adapted for use in a lighting device comprising a shaft which is at least partially hollow, at least three electrically insulating discs mounted transversely on said shaft, each of said discs carrying at least one electrical contact ring, said electrical contact rings arranged on said discs such that there are two pairs of electrical contact rings, each pair separated from each other, and such that the contact rings of each pair are in slidable electrical contact with each other, a housing about said shaft and said discs, a portion of the housing engaging at least one of the discs such that when the housing portion is rotated relative to the shaft, the engaged disc is caused to rotate about the shaft, and at least four electrical conductors extending from the unit, each electrical conductor attached to a different contact ring.

Further objects and features of the present invention as well as many specific advantages will become more fully apparent from a detailed consideration of the remainder of this disclosure taken in conjunction with the accompanying drawings and the appended claims.

DETAILED DESCRIPTION OF THE PREFERRED EMBODIMENTS

Figure 1:
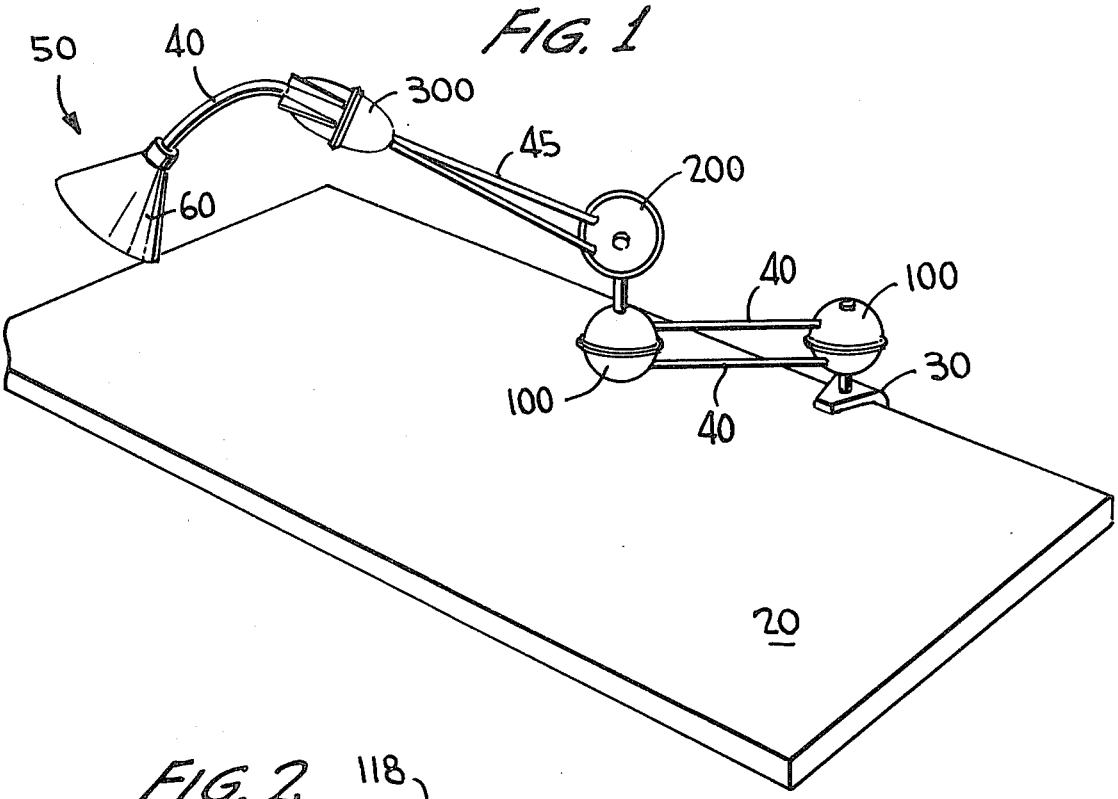
FIG. 1 is a view of one embodiment of an electrical lighting device having rotatable electrical connector units in accordance with the present invention.

In FIG. 1, an electrical lighting device 10 is shown attached to the surface of table 20. The device 10 includes attachment member 30 for securing the device to the surface of table 20, rotatable electrical connector units 100, 200 and 300 in accordance with the present invention joined to one another by arm members 40 and 45, and lamp unit 50 including a light directing shade 60 and a source of illumination (not shown) within the shade. As will be evident, lamp unit 50 of lighting device 10 is capable of being placed in numerous positions relative to the table 20 so as to direct light of any desired intensity onto the surface of the table or surfaces adjacent thereto.

The specific construction of each of the rotatable electrical connector units 100, 200 and 300 is more clearly shown in FIGS. 2 through 7.

Figure 2:
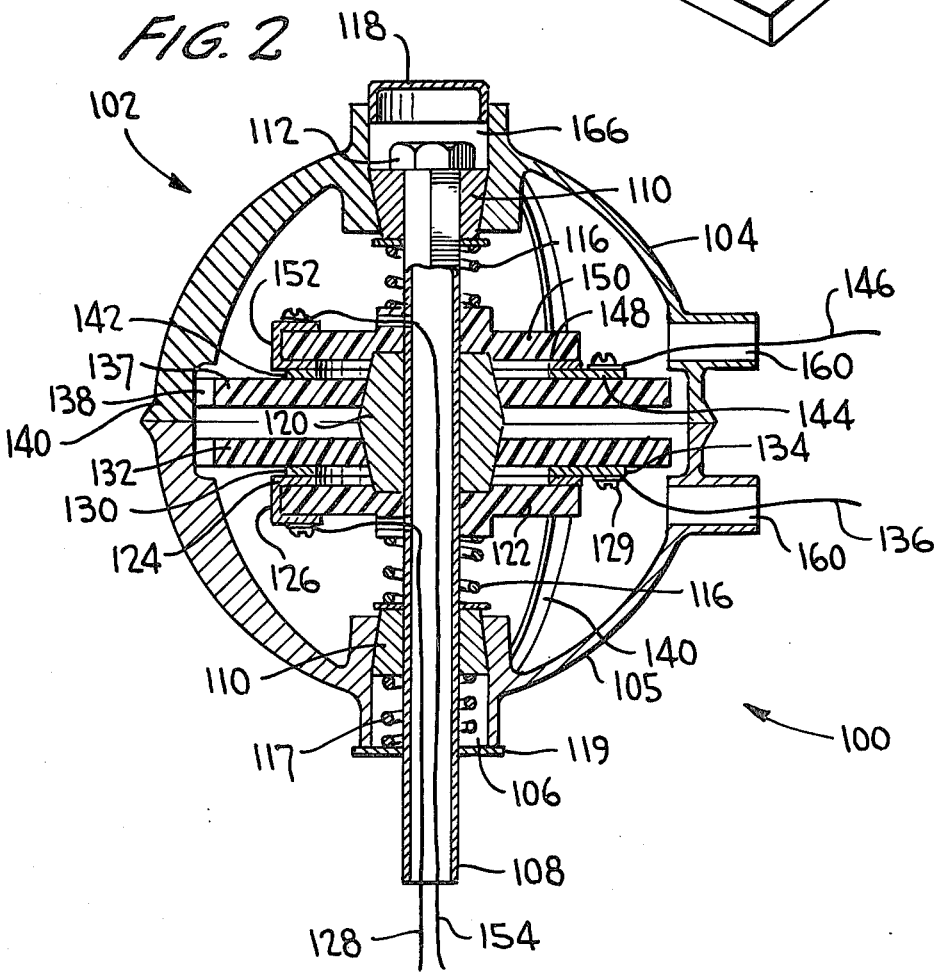
FIG. 2 is a partial cross-sectional view of one of the rotatable electrical connector units of FIG. 1.
Figure 3:
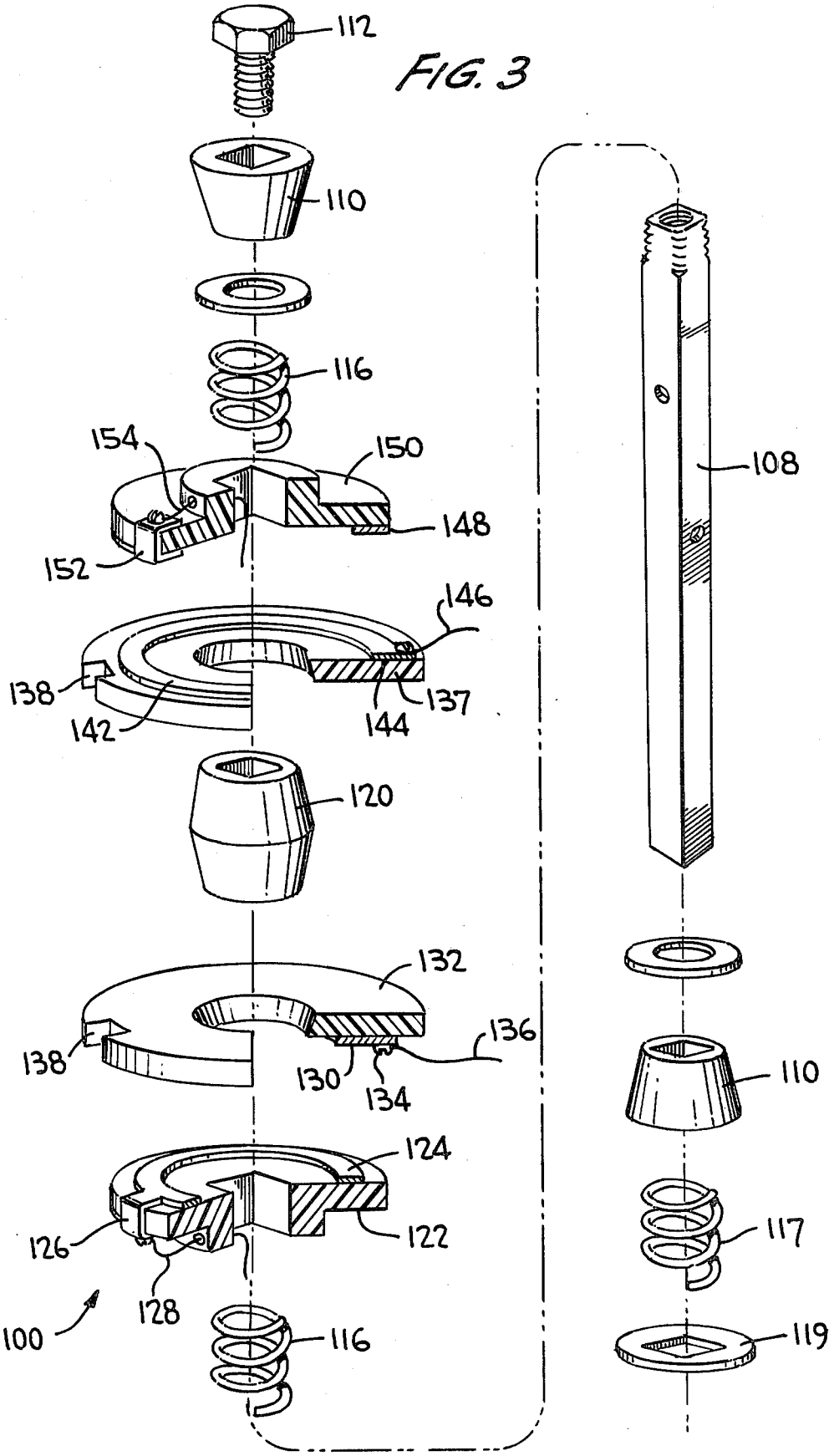
FIG. 3 is an exploded perspective view of the rotatable electrical connector unit shown in FIG. 2 without the housing.

In FIGS. 2 and 3, rotatable electrical connector unit 100 includes generally spherical housing 102 of two essentially identical housing halves 104 and 105. Although the housing 102 as shown consists of two housing halves 104 and 105, the housing halves of unit 100 would be integral without affecting the operation of the unit. In addition, housing 102 could be of configurations other than generally spherical such as cylindrical and the like.

Each of the housing halves 104 and 105 has a circular opening 106 through which hollow shaft 108 extends on a central axis of the housing 102. Shaft 108 has a generally square external configuration and extends beyond the external surface of housing half 105 for a short distance. The portion of each opening 106 which is adjacent to the interior of housing 102 has an inwardly sloping circular wall such that each portion defines a funnel-shaped opening.

On each end portion of shaft 108 and within the funnel-shaped portion of opening 106 is a wedge member 110 having an external shape the same as the sloping walls of the openings, the upper wedge member being held in position on the shaft by threaded bolt 112 on one side and spring 116 on the shaft by threaded bolt 112 on one side and spring 116 on the other side. Lower wedge member 110 is held in position within the funnel-shaped portion of opening 106 in housing half 105 by a second spring 116 on one side and spring 117 on the other side. Flange member 119 of shaft 108 retains spring 117 within the opening 106. Closing opening 106 in upper housing half 104 is cap 118 which may be press-fit into the opening as shown or alternatively, be provided with exterior threads mating with internal threads in the opening.

Fixedly attached about the center of shaft 108 is double wedge member 120 which has two external sloping surfaces of varying diameters with the largest diameter at the central portion. The external configuration of double wedge member 120 may be described as two truncated cones joined at their respective bases. Engaging the lower sloping portion of wedge member 120 is electrically insulating disc 120 carrying electrical contact ring 124. An extending ear 126 of contact ring 124 is bent about the edge of disc 122 and is connected to an electrical conductor such as electrical wire 128 by screw 129. Electrical wire 128 passes through a passage in disc 122, an opening in shaft 108 and thence out through the base of the shaft. In slidable electrical contact with contact ring 124 is concentric electrical contact ring 130 carried on the lower surface of electrically insulating disc 132. Electrical contact ring 130 includes an extending ear 134 which is connected to electrical wire 136 by screw 129.

Engaging the upper sloping surface of wedge member 120 is electrically insulating disc 137. Disc 137 carries on its upper surface electrical contact ring 142 having an extending ear 144 connected to electrical wire 146 by screw 129. Contact ring 142 is in slidable contact with concentric contact ring 148 carried by electrically insulating disc 150. An extending ear 152 of contact ring 148 is bent about the edge of disc 150 and is connected to electrical wire 154, the wire extending through a passage in disc 150, the wall of shaft 108 and thence out the bottom portion of the shaft.

Contact ring pair 124 and 130 and contact ring pair 142 and 148 are forced into good electrical contact with each other by springs 116 acting against disc 122 and disc 150 respectively.

The internal surfaces of discs 122, 132, 137 and 150 which contact the sloping surfaces of double wedge member 120 have approximately the same slope as the surfaces of the double wedge member. Thus, the double wedge member 110 provides a bearing surface for the discs 132 and 137 and, in conjunction with springs 116, helps to maintain discs 122, 132, 137 and 150 in a fixed position relative to the shaft 108. In addition, springs 116 acting against discs 122 and 150 tend to force the discs into frictional engagement with double wedge member 120 to thereby help prevent rotation of the housing 102 and help support portions of a lighting device utilizing the unit 100 in a stationary position.

Discs 132 and 137 each have a plurality of notches 138 on their outer peripheries and the housing halves 104 and 105 each have a plurality of internal ribs 140, each rib projecting through a notch of a disc. Preferably, each housing half 104 and 105 has three ribs 140 spaced equally about the inner surface of the housing half. Thus as a housing half 104 or 105 is rotated relative to the shaft 108 either disc 132 or 137 is caused to rotate a corresponding amount.

Each of the housing halves 104 and 105 is also provided with an opening 160 through which an electrical wire extends. As is shown, wire 136 extends through opening 160 in the lower housing half 105 and wire 146 extends through opening 160 in the upper housing half 104. Wire 136 is in electrical contact with wire 128 by means of contact rings 124 and 130 and wire 146 is in electrical contact with wire 154 by means of contact rings 142 and 148.

To illustrate the operation of the rotatable electrical connector unit 100, assume that housing 102 is rotated while the shaft 108 is held stationary. Upon rotation of the housing 102, the rotation is transferred to discs 132 and 137 by ribs 140 and thence to contact rings 130 and 142. Thus wires 136 and 146 rotate with the housing 102. Since shaft 108 does not rotate, disc 122 and disc 150 and hence contact rings 124 and 148 will not rotate.

As is apparent, the rotation of housing 102 relative to shaft 108 will produce no twisting or bending of any of the wires associated with unit 100 while good electrical contact with the respective pairs of wires is still maintained.

The force fit between wedge members 110 and the sloping walls of the openings 106 in housing halves 104 and 105 provides the necessary friction so that the housing 102 does not freely rotate about shaft 108 and thereby is able to support the weight of a lighting device and allow the unit 100 to remain in a fixed position after the desired manual rotation of the housing. The degree to which the wedge members 110 are forced into the sloping walls of opening 106 can be regulated by adjustment of bolt 112 within shaft 108 and/or by the strength characteristics of spring 117.

Figure 4:
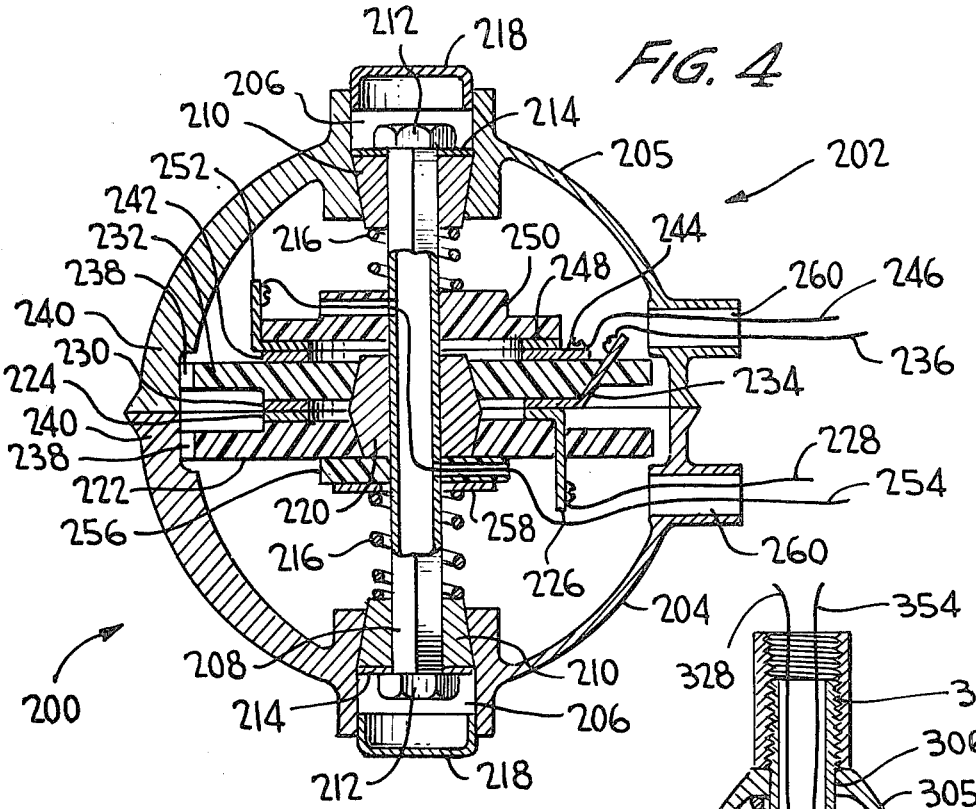
FIG. 4 is a partial cross-sectional view of another of the rotatable electrical connector units of FIG. 1.
Figure 5:
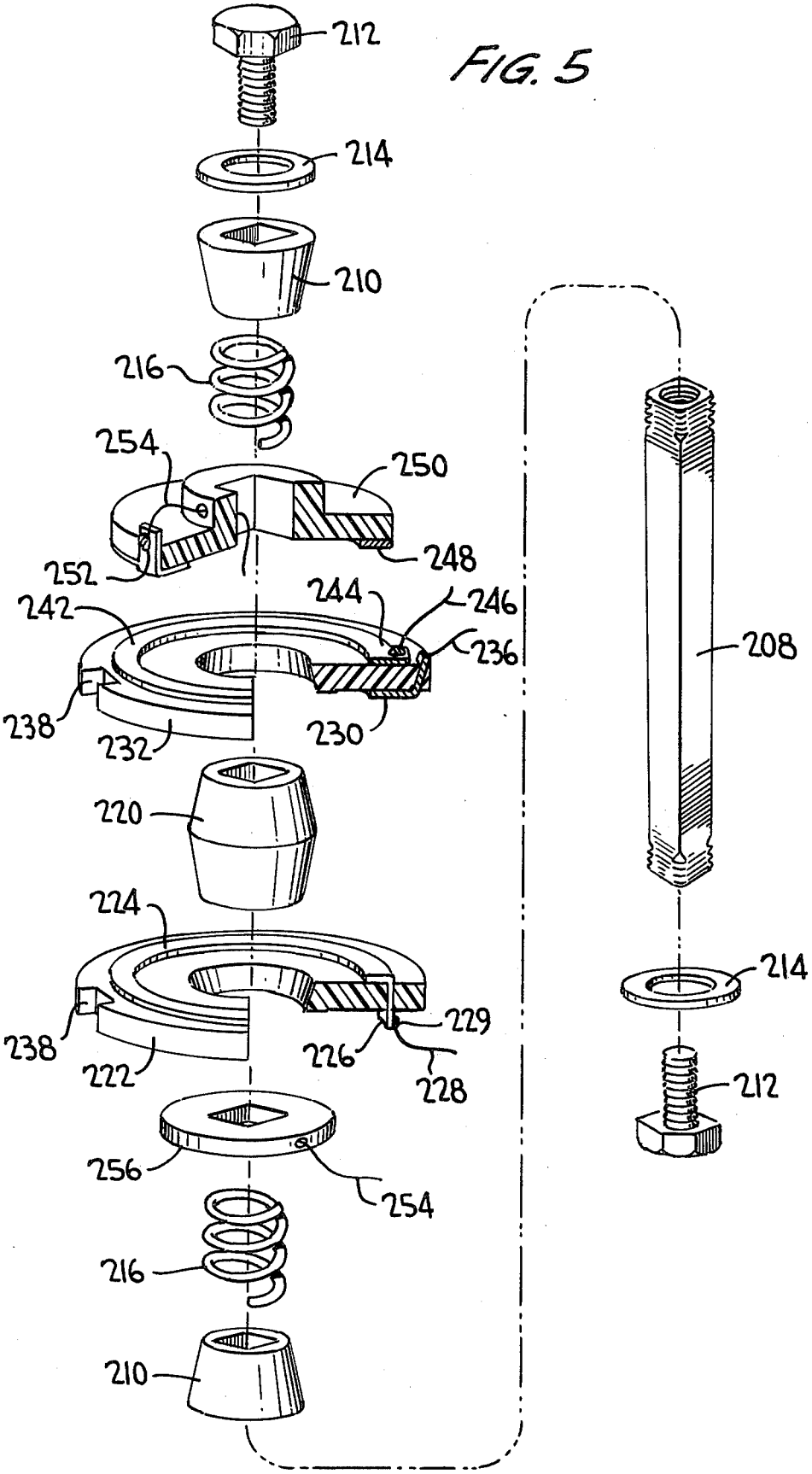
FIG. 5 is an exploded perspective view of the rotatable electrical connector unit shown in FIG. 4 without the housing.

In FIGS. 4 and 5, rotatable electrical connector unit 200 is shown which is quite similar in some respects to unit 100 described above. Rotatable electrical connector unit 200 includes a protective housing 102 of generally spherical configuration comprising housing halves 204 and 205. Each of the housing halves 204 and 205 has a circular opening 206 through which hollow shaft 208 extends on a central axis of the housing 202. The portion of each opening 206 which is adjacent to the interior of housing 202 has an inwardly sloping circular wall such that the portions define a funnel-shaped opening.

Fixedly attached to each end of shaft 208 is a wedge member 210 having an external shape approximately the same as the walls of the openings adjacent to the interior of the housing 202. Each wedge member 210 is held in position axially on the shaft by threaded bolt 212 and washer 214 on one side and spring 216 on the other side. Closing the interior of each opening 206 is a cap 218 which may be press-fit into the opening as shown or, alternatively, which may be provided with exterior threads mating with internal threads in the opening (not shown).

The force fit between wedge members 210 and the sloping walls of the openings 206 in housing halves 204 and 205 helps provide the necessary friction so that the housing halves do not freely rotate about shaft 208. The unit 200 is therefore able to support the weight of the arms and illuminating portion of a lighting device and will remain in a stationary position after the desired manual rotation of a housing half. The degree to which the wedge members 210 are forced into the sloping walls of opening 206 can be regulated by the adjustment of bolts 212 within the bore of the shaft 208.

Fixedly attached about the center of shaft 208 is double wedge member 220 which has two external sloping surfaces of varying diameters with the largest diameter at the central portion. The configuration and function of double wedge member 220 is generally the same as wedge member 120 of unit 100 described previously. Engaging the lower sloping portion of wedge member 220 is electrically insulating disc 222 carrying electrical contact ring 224. An extending ear 226 of contact ring 224 projects through disc 222 and is connected to electrical wire 228. In slidable electrical contact with contact ring 224 is another electrical contact ring 230 carried on the lower surface of electrically insulating disc 232. Contact ring 230 includes an extending ear 234 projecting through disc 232 and connected to electrical wire 236.

Discs 222 and 232 each have a plurality of notches 238 on their outer peripheries and the housing halves 204 and 205 each have a plurality of internal ribs 240, each rib projecting through a notch of one of the discs. Preferably, each housing half 204 or 205 has three ribs 240 spaced equally about the inner surface of the housing half. Thus as housing half 204 and 205 is caused to rotate relative to the shaft, either disc 222 or 232 is caused to rotate a corresponding amount.

Disc 232 carries on its upper surface contact ring 242 having an extending ear 244 connected to electrical wire 246. Contact ring 242 is in slidable contact with concentric contact ring 248 carried by electrically insulating disc 250. An extending ear 252 of ring 248 is connected to electrical wire 254, the wire extending through an opening in disc 250, the wall of shaft 208 and thence through an opening in disc 256 adjacent to disc 222.

The rings of contact ring pair 224 and 230 and ring pair 242 and 248 are respectively forced into good electrical contact with each other by springs 216 acting against washers 258 located adjacent to discs 250 and disc 256.

Each of the housing halves 204 and 205 is provided with an opening 260 through which a pair of electrical wires extend. As is shown, wires 228 and 254 extend through opening 260 in the lower housing half 204 and wires 236 and 246 extend through opening 260 in the upper housing half 205. Wire 254 is in electrical contact with wire 246 by means of contact rings 242 and 248 and wire 228 is in electrical contact with wire 236 by means of contact rings 224 and 230.

To illustrate the operation of the rotatable electrical connector unit 200, assume that upper housing half 205 as is shown in FIG. 5 is rotated while the lower housing half 204 is held stationary. Upon rotation of the upper housing half 205, the rotation is transferred to disc 232 and hence to contact rings 242 and 248. Upper housing half 205 will rotate about the upper wedge member 210 through disc 232 being carried by rib 240. Thus wires 236 and 246 rotate with the housing half 205. Since lower housing half 204 does not rotate, discs 222, shaft 208 and disc 250 also will not rotate.

As is apparent, the rotation of upper housing half 205 relative to lower housing half 204 will produce no twisting or bending of any of the wires associated with unit 200 while good electrical contact with the respective pairs of wires is still maintained.

As is clear from an examination of the rotatable connector units 100 and 200, the two units may utilize essentially the same housing. The housings may be of any material which will provide the requisite strength for protecting the interior components of the units from mechanical damage and for preventing access to the interior of the unit by a user of the unit who might otherwise be subjected to an electrical shock. Presently preferred materials for the housing include metals such as aluminum, polymeric materials and ceramic type materials.

Figure 6:
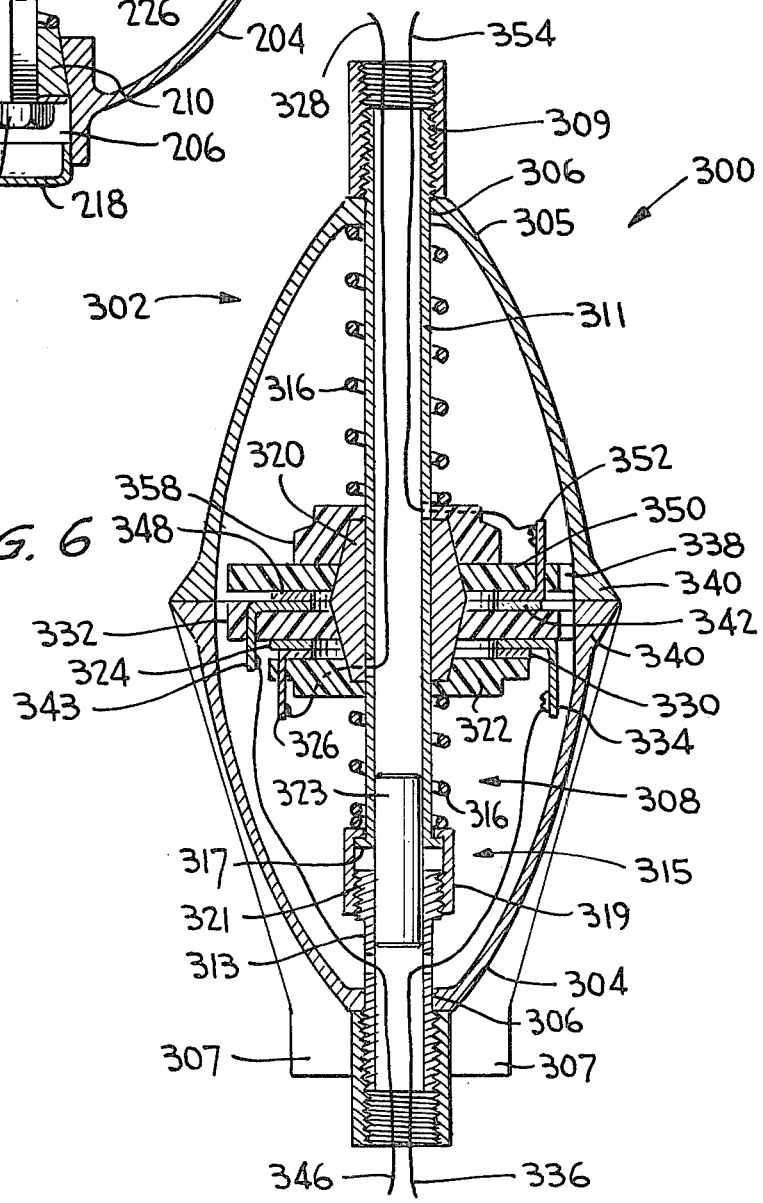
FIG. 6 is a partial cross-sectional view of yet another of the rotatable electrical connector units of FIG. 1.
Figure 7:
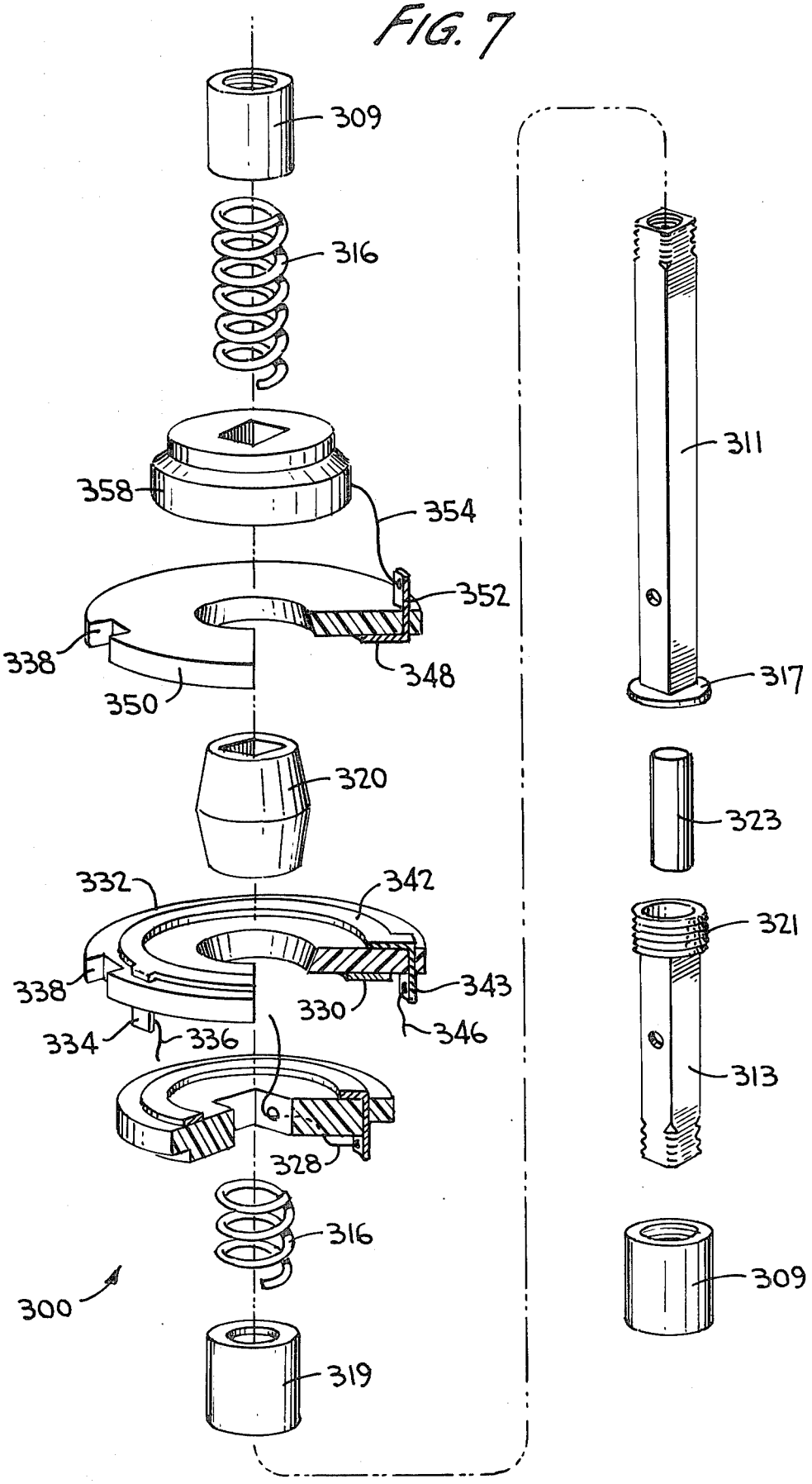
FIG. 7 is an exploded perspective view of the rotatable electrical unit shown in FIG. 6 without the housing.

In FIGS. 6 and 7, rotatable electrical conductor unit 300 is illustrated which includes protective housing 302 of a generally oval-shaped configuration comprising housing halves 304 and 305. Lower housing half 304 includes a plurality of external ribs 307 spaced about the circumference of the housing half. Ribs 307 facilitate the manual rotation of housing half 304 relative to housing half 305.

Each of the housing halves 304 and 305 has a square shaped opening 306 through which hollow, jointed shaft 308 having a generally squared-shaped cross-section extends on the axis of housing 302. The distal ends of shaft 308 have external threads which engage the internal threads of nipples 309 thereby holding housing 302 in a fixed position relative to the shaft. The shaft 308 comprises upper shaft portion 311 and lower shaft portion 313 held in a rotatable engagement by joint 315.

Joint 315 allows shaft portions 311 and 313 to rotate relative to each other about the longitudinal axis of shaft 308. The lower end of upper shaft portion 311 has protruding circular flange 317 about which internally threaded collar 319 is located for rotation. Collar 319 mates with externally threaded coupling member 321 fixedly attached to lower shaft portion 313. Cylindrical plug member 323 attached to upper shaft portion 313 projects through the collar 319 and coupling member 321 and into the bore of lower shaft portion 311. Plug member 323 helps to maintain the axial alignment of the upper shaft portion 311 and lower shaft portion 313 relative to each other.

Slidably attached to the upper shaft portion 311 at the central horizontal axis of housing 312 is double wedge member 320 having two sloping external conical type surfaces, the central portion of which having the largest diameter. The configuration and function of double wedge member 320 is generally the same as double wedge member 120 of unit 100 described previously. Contacting the lower portion of the wedge member 320 is electrically insulating disc 322 carrying electrical contact ring 324 which has ear 326 extending through the disc. Disc 322 is fixed to upper shaft portion 311 for rotation but is capable of sliding longitudinally on the shaft portion. Electrical wire 328 is fixedly attached to ear 326 and extends through a passage in disc 322 and the wall of upper shaft portion 311 into the internal bore of that shaft portion.

In electrical contact with contact ring 324 is another contact ring 330 carried by electrically insulating disc 332. Contact ring 330 includes a downwardly extending ear 334 which is in electrical contact with electrical wire 336. Wire 336 passes through an opening in the wall of lower shaft portion 313 and into the internal bore of that shaft portion.

Carried on the other major surface of disc 332 is contact ring 342 having an ear 343 extending downwardly through the disc. Attached to ear 343 is electrical wire 346 which passes through an opening in the wall of lower shaft portion 313 and into the internal bore of the shaft portion. In electrical contact with contact ring 342 is electrical contact ring 348 carried by electrically insulating disc 350. Ear 352 of contact ring 348 extends through disc 350 and is connected to wire 354. Adjacent to the upper surface of disc 350 is an electrically insulating washer 358. Wire 354 passes through a passage in washer 358 and thence through an opening in the upper shaft portion 311 into the internal bore of the shaft portion.

Springs 316 are located about sections of the upper shaft portion 311, the ends of the upper spring contacting the washer 358 and the housing half 304 and the ends of the lower spring contacting the disc 322 and the upper portion of joint 315. The springs 316 cooperate to insure that the pair of electrical contact rings 324 and 330 and the pair of electrical contact rings 342 and 348 are each held in good electrical contact.

Discs 322 and 350 each include a plurality of notches 338 spaced about the periphery, each notch engaging a rib 340 of the internal surfaces of the respective housing halves 304 and 305. Thus as housing halves 304 and 305 are rotated relative to one another, discs 332 and 350 are rotated an amount corresponding to the amount the respective housing halves are rotated.

In operation of the rotatable electrical unit 300, it is apparent that if wires 336 and 346 are attached to an electrical source (not shown) and wires 328 and 354 connected to a load (not shown), electrical current will be conducted to wires 328 and 354 by means of the pair of contact rings 324 and 330 and the pair of contact rings 342 and 348. The electrical current will be conducted even if shaft portion 313 is rotated relative to shaft portion 311.

For purposes of illustration, assume that upper shaft portion 313 remains stationary while lower shaft portion 311 is rotated. When shaft portion 311 is rotated, housing half 304 rotates a corresponding amount as well as disc 332 and contact rings 330 and 342 by means of the notches of the disc engaging rib 340 of the housing half. Since discs 322 and 350 are fixed to upper shaft portion 313, contact rings 324 and 348 will remain stationary during rotation of lower shaft portion 313. Thus rotation of a portion of electrical unit 300 through a full 360° is possible without bending or twisting of the associated electrical wires and the unit is therefore capable of conducting electric current no matter what the relative positions the housing halves are to each other.

Figure 8:
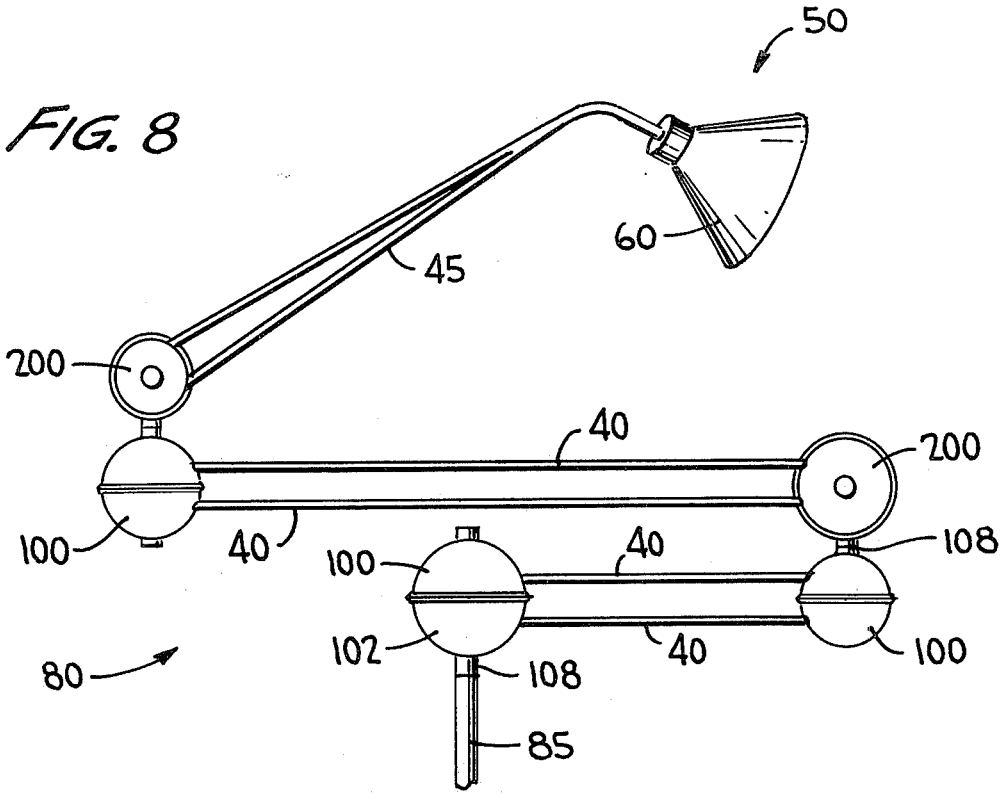
FIG. 8 is a perspective view of another embodiment of an electrical lighting device having rotatable electrical connector units in accordance with the present invention.
Figure 9:
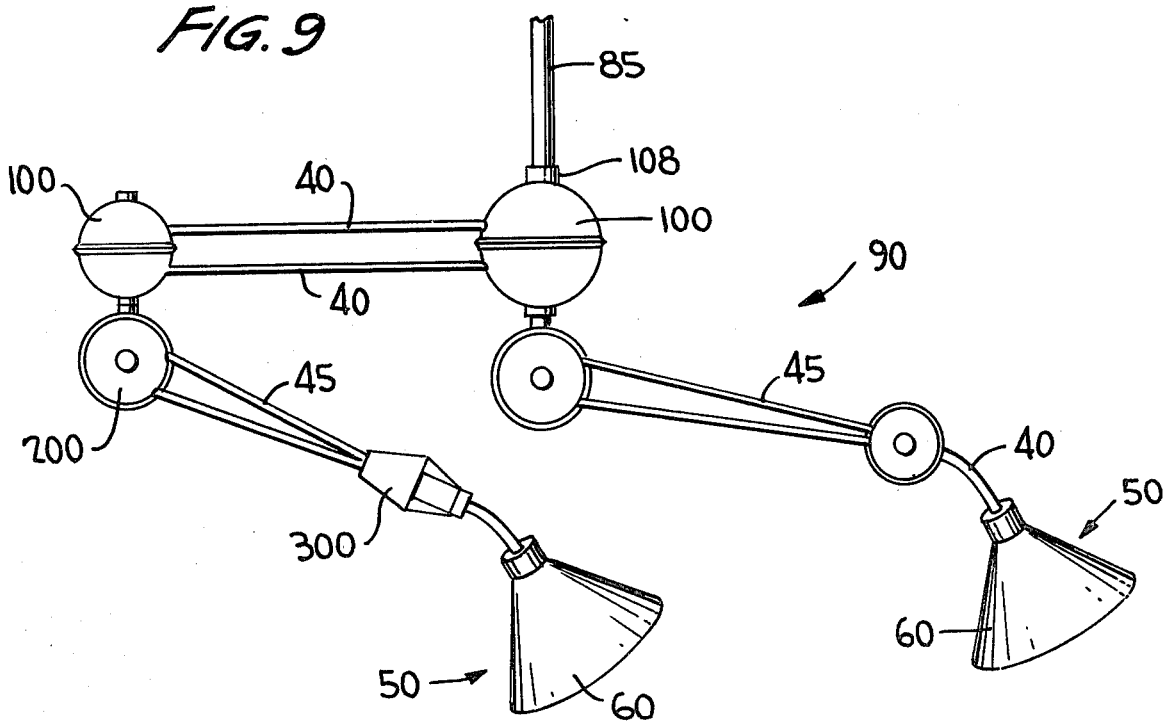
FIG. 9 is a perspective view of yet another embodiment of an electrical lighting device having rotatable electrical connector units in accordance with the present invention.

The varied usefulness of the previously described rotatable electrical connector units 100, 200 and 300 is illustrated in FIGS. 8 and 9. In FIG. 8, adjustable lighting device 80 includes shaft 85 which is adapted to be attached to an attachment member (not shown). The attachment member allows the device to either be fixed or removably attached to a variety of surfaces such as table tops, poles, walls, ceilings, machines, other fixtures and the like.

Rotatable electrical connector unit 100 of device 80 is fixedly attached to shaft 85 by shaft 108 of the unit. Since housing 102 of unit 100 is capable or rotating about shaft 108, arms 40 fixedly attached to the housing 102 can be rotated a full circle about shaft 85. Attached at the other ends of arms 40 is a second rotatable electrical connector unit 100, the arms being fixedly attached to the housing 102 of the unit. Shaft 108 extending from second unit 100 is attached to one of the housing halves of housing 202 of rotatable electrical connector unit 200. Two arms 40 extend from the other half of the housing 202. With such an arrangement of the second unit 100 and unit 200, the ends of arms 40 opposite the ends attached to unit 200 can be moved either horizontally or vertically or combinations thereof.

At the ends of arms 40 remote from unit 200 is a second rotatable electrical connector unit pair including unit 100 and unit 200, the pairs operating in the same fashion as the first unit pair. Extending from one of the housing halves of unit 200 is arm member 45 connected to lamp 50 having shade 60.

Thus, in operation, the lamp 50 of lighting device 80 as shown in FIG. 8 can be moved to a multitude of positions and light emanating from the lamp 50 can be directed in almost any direction and at any desired intensity to facilitate examination of an object.

FIG. 9 illustrates a further embodiment of an adjustable lighting device incorporating rotatable electrical connector units in accordance with the present invention. The device 90 will not be described in detail as its operation and function will be evident from the description of the lighting device of FIG. 8 since the same identifying numerals have been utilized in FIG. 9.

As will be obvious from a consideration of the embodiments of a lighting device as illustrated in FIGS. 1, 8 and 9, many other combinations of rotatable electrical connector units 100, 200 and/or 300 are feasible to produce useful adjustable lighting devices. For example, a limited purpose adjustable lighting device could be made which includes only one of the rotatable electrical connector units as were described previously. Conversely, an adjustable lighting device for a very specialized purpose could include a combination of a great number of the various rotatable electrical connector units.

While the rotatable electrical connector units of the present invention have been illustrated primarily for use in an adjustable lighting device, it will be apparent to those skilled in the art that the units may also be effectively utilized in other devices where an electrical connection through a rotatable mechanical joint is desirable.

Therefore, it should be understood that the embodiments of the rotatable electrical connector units and of the lighting devices have been presented for the purpose of illustration only and that the embodiments do not limit the invention as has heretofore been described or as defined in the appended claims.

I claim:

1. A rotatable electrical connector unit adapted for use in a lighting device comprising a shaft which is at least partially hollow, at least three electrically insulating discs mounted transversely on said shaft, each of said discs carrying at least one electrical contact ring, said electrical contact rings arranged on said discs such that there are two pairs of electrical contact rings, each pair separated from each other, and such that the contact rings of each pair are in slidable electrical contact with each other, a housing including two portions capable of rotating relative to each other and about said shaft and said discs, the housing portions fixed to each end of the shaft and the shaft includes a rotatable joint within the housing which allows the end portions of the shaft and their respective housing portions to be rotated with respect to each other about the longitudinal axis of the shaft, one portion of the housing engaging at least one of the discs such that when the housing portion is rotated relative to the shaft, the engaged disc is caused to rotate about the shaft, and at least four electrical conductors extending from the unit, each electrical conductor attached to a different contact ring.

2. A rotatable electrical connector unit according to claim 1 wherein the contact rings of each pair are forced into engagement by springs about the shaft.

3. A rotatable electrical connector unit according to claim 1 wherein the discs engaging the housing rotate about a double wedge member carried by the shaft.

4. A rotatable electrical connector unit according to claim 1 wherein the housing engages discs by means of one or more ribs on the inner surface of the housing each passing through a notch in a disc.

5. A rotatable electrical connector unit according to claim 1 wherein the housing is generally spherical.

6. A lighting device having illuminating means including at least one of the rotatable electrical connector units of claim 1.

7. A rotatable electrical connector unit according to claim 1 including four insulating discs, each disc carrying an electrical contact ring, and one of the discs carrying one of the contact rings of each pair engaging the housing, the other disc of each pair fixed to the shaft.

8. A rotatable electrical connector unit according to claim 7 wherein an electrical conductor from each contact ring pair extends through openings in the housing and the other electrical conductor from each contact pair extends through the hollow portion of the shaft.

9. A rotatable electrical connector unit according to claim 1 wherein the shaft includes at least one tapered wedge member slidable on the shaft which engages a tapered opening in the housing.

10. A rotatable electrical connector unit according to claim 9 wherein the shaft includes two wedge members located near each end of the shaft.

11. A rotatable electrical connector unit according to claim 9 wherein means are provided on an end of the shaft to adjust the degree of engagement of the wedge member with the opening in the housing.

12. A rotatable electrical connector unit according to claim 1 wherein the discs are located about one of the shaft portions and the housing portion fixed to that shaft portion engages one of the discs nearest the end of the shaft, the other housing portion engaging the disc which carries two contact rings and is between the discs nearest the ends of the shaft.

13. A rotatable electrical connector unit according to claim 12 wherein the housing portions engage the respective discs by means of one or more ribs on the interior surface of each of the housing portions passing through a notch on the disc.

14. A rotatable electrical connector unit according to claim 12 wherein one electrical conductor from each contact pair extends into each shaft portion.

15. A rotatable electrical connector unit according to claim 14 wherein the electrical conductors extend from the ends of the shaft.

16. A rotatable electrical connector unit according to claim 15 wherein the contact ring pairs are forced into good electrical contact by springs about the shaft.

* * * * *